United States Patent [19]

Christensen

[11] Patent Number: 4,838,609

[45] Date of Patent: Jun. 13, 1989

[54] SWING COUCH

[76] Inventor: Daniel R. Christensen, 105 Walnut, Cleveland, Minn. 56017

[21] Appl. No.: 189,383

[22] Filed: May 2, 1988

[51] Int. Cl.[4] ..... A47D 13/10

[52] U.S. Cl. ..... 297/277; 297/278; 297/280; 297/457

[58] Field of Search ..... 247/281, 277, 278, 280, 247/274, 457, 441; 5/72, 80

[56] References Cited

U.S. PATENT DOCUMENTS

| | | | |
|---|---|---|---|
| 664,933 | 1/1901 | Durnell | 297/277 |
| 1,125,801 | 1/1915 | Blood | 297/277 |
| 1,405,768 | 2/1922 | Ekehorn | 297/278 |
| 2,398,384 | 4/1946 | Meyers | 297/280 |
| 4,164,356 | 8/1979 | Knight | 297/457 |
| 4,351,524 | 9/1982 | Gomes | 297/280 |

*Primary Examiner*—Francis K. Zugel

*Attorney, Agent, or Firm*—Peterson, Wicks, Nemer & Kamruth

[57] ABSTRACT

A preferred form of a swing couch (10) is disclosed including a frame (18) suspended by a flaccid member (22) secured to ends (20) of the frame (18) and extending around and being supported by a pulley (24). Frame (18) can be adjusted between vertical to horizontal positions and held by clamping the flaccid member (22) adjacent pulley (24). Upholstery material (12) is draped between and secured to upper and lower horizontal cross beams (14, 16) of the frame (18) by having the free ends of the material (12) clamped to the beams (14, 16) while being wrapped around at least two corners of the beams (14, 16) to allow minimal adherence securement. A seat support (38) is adjustably suspended generally parallel to and slightly below the lower beam (16) by flaccid members (40) extending from ends (20). A back support (26) is pivotally mounted within the frame (18) about its upper edge by an axis which is parallel to and adjacent the upper beam (14). The lower edge of back support (26) is adjustably supported by flaccid members (28) extending from ends (20). Thus, the swing couch (10) conforms to the user's body without creating pressure points but provides sufficient skeletal support to encourage good posture.

19 Claims, 1 Drawing Sheet

SWING COUCH

BACKGROUND

The present invention relates generally to furniture and specifically to swing couches.

A need has arisen for furniture which is versatile in function while being easy and inexpensive to manufacture, store, ship, and inventory. Further, such furniture should conform to the user's body without creating pressure points while providing sufficient support to encourage good posture and discourage slouching.

SUMMARY

The present invention solves these needs and other problems in furniture design by providing a swing couch including, in a first aspect of the present invention, a back support pivotally mounted within a generally rectangular frame by an axis which is parallel to and adjacent the upper horizontal cross beam of the frame. The lower edge of the back support is adjustably supported relative to the frame.

In another aspect of the present invention, a swing couch is provided including a seat support adjustably supported from and within a generally rectangular frame generally parallel to and slightly below the lower horizontal cross beam of the frame.

In still another aspect of the present invention, upholstery material is draped between and secured to the upper and lower horizontal cross beams of a swing couch. The free ends of the upholstery material is clamped to the upper and lower horizontal cross beams, with the upholstery material being wrapped around at least two corners of the upper and lower horizontal cross beams to allow securement with minimal adherence of the upholstery material.

It is thus an object of the present invention to provide a novel swing couch.

It is further an object of the present invention to provide such a novel swing couch which is versatile in function.

It is further an object of the present invention to provide such a novel swing couch which is easy and inexpensive to manufacture, store, ship and inventory.

It is further an object of the present invention to provide such a novel swing couch which conforms to the user's body.

It is further an object of the present invention to provide such a novel swing couch which does not create pressure points.

It is further an object of the present invention to provide such a novel swing couch which allows the body to fill voids.

It is further an object of the present invention to provide such a novel swing couch which provides sufficient skeletal support.

It is further an object of the present invention to provide such a novel swing couch which encourages good posture.

It is further an object of the present invention to provide such a novel swing couch which discourages slouching.

It is further an object of the present invention to provide such a novel swing couch which is easily adjustable from upright chair positions, to recliner positions, and to sleeper positions.

It is further an object of the present invention to provide such a novel swing couch which allows securement of the upholstery material with minimal adherence.

It is further an object of the present invention to provide such a novel swing couch having upholstery material which is easily adjusted and fitted.

It is further an object of the present invention to provide such a novel swing couch allowing easy and frequent changes of the upholstery material.

It is further an object of the present invention to provide such a novel swing couch having only the ends of the frame exposed allowing unique appearances by the selection of the forms of the ends.

It is further an object of the present invention to provide such a novel swing couch which minimizes manufacturing handling by concentrating manufacturing steps on two identical pieces of the frame.

These and further objects and advantages of the present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

Figures 1, 2, 3, 4, 5:
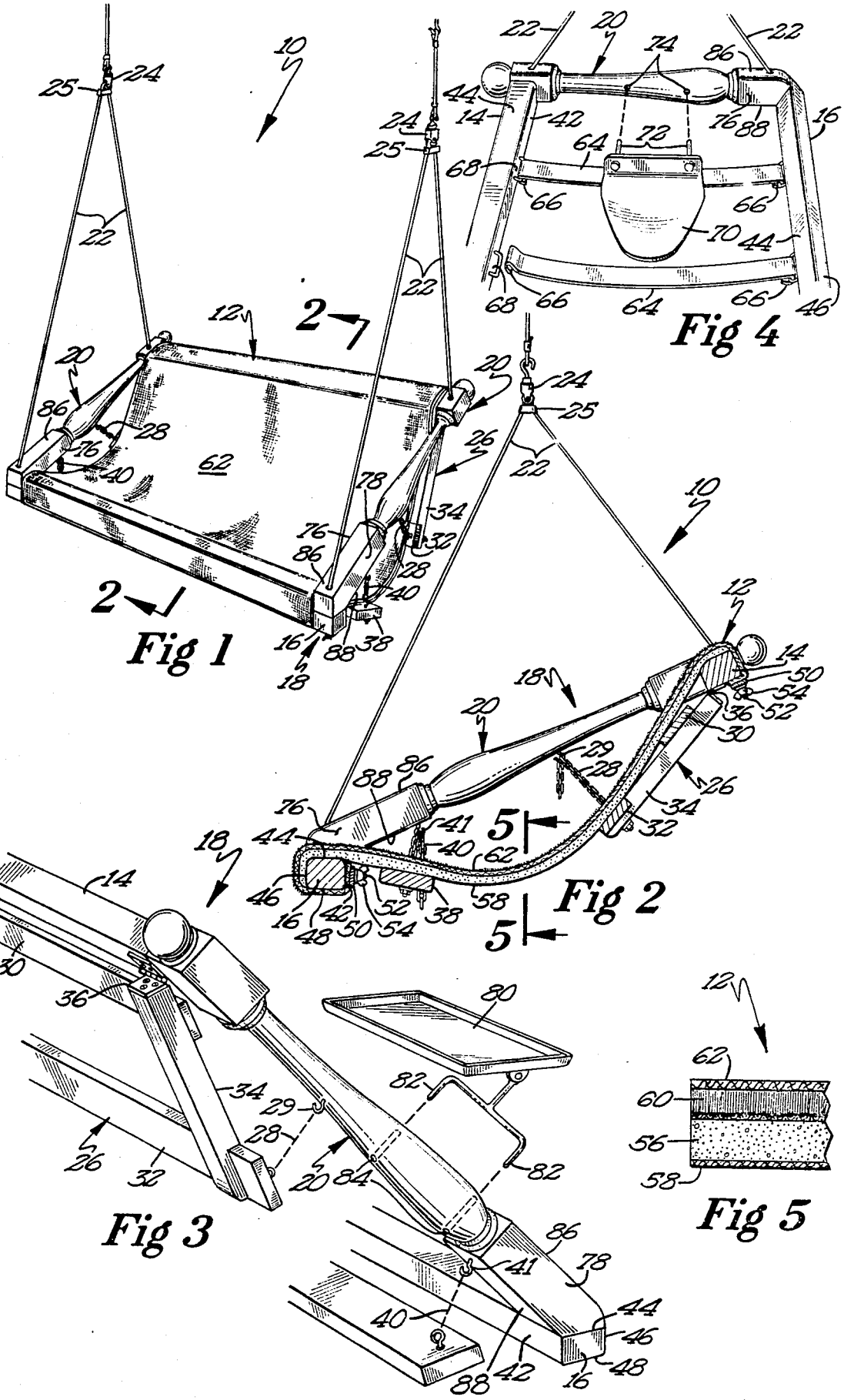
FIG. 1 shows a perspective view of a swing couch according to the preferred teachings of the present invention.
FIG. 2 shows a cross sectional view of the swing couch of FIG. 1 according to section line 2—2 of FIG. 1.
FIG. 3 shows a partial, perspective view of the swing couch of FIG. 1, with portions being removed.
FIG. 4 shows a partial, perspective view of an alternate use of the swing couch of FIG. 1 in a sleeper position, with portions being removed.
FIG. 5 shows enlarged cross sectional view of the swing couch of FIG. 1 according to section line 5—5 of FIG. 2.

All figures are drawn for ease of explanation of the basic teachings of the present invention only; the extensions of the Figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "upper", "lower", "top", "bottom", "end", "side", "edge", "face", "first", "second", "inside", "outside", "inner", "outer", and similar terms are used herein, it should be understood that these terms have reference only to the structure shown in the drawings as it would appear to a person viewing the drawings and are utilized only to facilitate describing the invention.

DESCRIPTION

A swing couch according to the preferred teachings of the present invention is shown in the drawings and generally designated 10. Couch 10 generally is in the form of an ancient scroll, with upholstery material 12 draped between horizontal upper and lower cross beams 14 and 16, respectively, of a frame 18. Frame 18 may be formed in a square or rectangular shape and includes first and second ends 20 secured to and extending between the opposite ends of beams 14 and 16. Frame 18 is supported above the floor by any suitable means such as by ends 20 in the preferred form and in the most preferred form by an elongated flaccid member 22 such as a chain or rope supported from a point above couch 10 such as the ceiling. Specifically, in the most preferred form, flaccid member 22 has its free ends secured at spaced locations on ends 20 such as by extending through apertures formed in ends 20 and with the free ends of flaccid member 22 being knotted to prevent passage through the apertures of ends 20. Flaccid member 22 extends from ends 20 and passes around and is supported by a pulley 24 secured to the ceiling. Thus, the angle or tilt of frame 18 and couch 10 can be easily adjusted to accommodate for vertical to horizontal positions, from an upright chair or couch position, to a recliner position, or even flat to a sleeper position by simply pulling member 22 through pulley 24 until ends 20 are in their desired position. A clamp 25 may be provided adjacent pulley 24 for selectively preventing movement of member 22 around pulley 24 by clamping member 22 together for holding member 22 relative to pulley 24 and thus for holding frame 18 and couch 10 in the desired position. In its most preferred form, pulleys 24 may be supported above the floor by attachment to the ceiling joists or other building structural member, by attachment to a horizontal support held against the ceiling by two vertical supports and held against horizontal movement by lag bolts extending into the ceiling, by attachment to a portable support frame, or by other suitable means.

Couch 10 according to the preferred teachings of the present invention further includes a back support 26 having a width generally equal to but of a size for receipt between ends 20 and having a height less than the spacing between beams 14 and 16. Back support 26 has an upper edge which is pivotally mounted about an axis parallel to and adjacent upper cross beam 14 and is supported adjacent its lower edge relative to frame 18. In the most preferred form, the lower edge of back support 26 is supported from ends 20 of frame 18 by an elongated flaccid member 28 such as a chain or rope extending from the lower edge of support 26 to end 20 of frame 18. To allow for ease of adjustment of the spacing of lower edge of back support 26 relative to ends 20, hooks 29 of suitable type and construction such as of the type shown are provided on ends 20 for allowing securement of flaccid member 28 at various lengths. Support 26 may be formed in a square or rectangular shape and includes upper and lower cross beams 30 and 32 secured between ends 34. In the most preferred form, beam 32 is positioned adjacent the lower edge of ends 34 and beam 30 is positioned intermediate the upper edge of ends 34 and beam 32. In the most preferred form, back support 26 is pivotally mounted to frame 18 by hinges 36 mounted on ends 20 of frame 18 and on ends 34 of back support 26.

Couch 10 according to the preferred teachings of the present invention further includes a seat support 38 having a width generally equal to but of a size for receipt between ends 20. Seat support 38 is supported adjacent lower cross beam 16 generally parallel to but slightly below cross beam 16 such as by an elongated flaccid member 40 such as a chain or rope extending from seat support 38 to end 20 of frame 18. To allow for ease of adjustment of the spacing of seat support 38 relative to ends 20, hooks 41 of suitable type and construction such as of the type shown are provided on ends 20 for allowing securement of flaccid member 40 at various lengths. Seat support 38 in the most preferred form may be a plank type member.

Upholstery material 12 is draped between and secured to cross beams 14 and 16 in the most preferred form by wrapping upholstery material 12 generally 360° around upper and lower cross beams 14 and 16, with the free ends of material 12 secured on the inner and bottom faces 42 and 48 of beams 16 and 14, respectively. Specifically, beams 14 and 16 are generally rectangular or square in cross section in the most preferred form and include inner faces 42, top faces 44, outer faces 46, and bottom faces 48. Upholstery material 12 extends at least over top faces 44, around the corner between top and outer faces 44 and 46, over outer faces 46, and around the corner between outer and bottom faces 46 and 48, and at least partially over bottom face 48, and may extend around the corner between inner and bottom faces 42 and 48, and at least partially over inner face 42. In the preferred form, the free end of material 12 is secured to face 48 of beam 14 and face 42 of beam 16 by clamping or sandwiching it between faces 42 and 48 and a securement bar 50. Securement bar 50 is movable relative to faces 42 and 48 such as by securement thereto by threaded studs 52 extending from faces 42 and 48 and through apertures formed in bar 50 and having wing nuts 54 which abut with bar 50 around the apertures. It can then be appreciated that bar 50 may be positioned adjacent material 12 extending between cross beams 14 and 16 such that bar 50, studs 52, and nuts 54 are out of sight.

Upholstery material 12 can take a variety of forms according to the teachings of the present invention. In the most preferred form of the present invention, a layer of foam 56 or other padding, stuffing, cushion or the like of any desired thickness can be added to any area of upholstery material 12 either at the factory or by the owner to eliminate any pressure areas and/or to enhance personal preference. Specifically, in the most preferred form, a first layer of support canvas 58 may be provided with foam 56 applied thereto such as by hook and loop type fasteners or double-sided tape. Carpeting 60 or other like layer of heavy sling support may be positioned adjacent foam 56 opposite canvas 58. Lastly, an outer layer of upholstery material 62 or the like may be added adjacent foam 56 and carpeting 60 for covering foam 56 and carpeting 60 for aesthetic reasons.

In the most preferred form, couch 10 further includes a plurality of generally parallel struts 64 which extend between inner faces 42 of cross beams 14 and 16 in spaced, parallel relationship for supporting upholstery material 12 when frame 18 is in its sleeper position or in other words when cross beams 14 and 16 are in the same horizontal plane. In the most preferred form, struts 64 are removably secured between and to cross beams 14 and 16 by having integral, downwardly extending lips 66 which are received in slots 68 formed in the most preferred form by staples extending into inner faces 42 of cross beams 14 and 16.

During use in its sleeper position, couch 10 may include a head and back rest insert 70 which may be removably mounted and attached to ends 20 of frame 18 according to the teachings of the present invention. In the most preferred form, insert 70 includes first and second posts 72 which are removably and slideably received in generally horizontal apertures 74 extending from the inner to the outer faces 76 and 78, respectively, of ends 20.

In the most preferred form of the present invention, couch 10 includes a tray insert 80 which may be removably mounted and attached to ends 20 of frame 18 according to the teachings of the present invention. In the most preferred form, insert 80 includes first and second posts 82 which are removably and slideably received in generally vertical apertures 84 extending from the top to the bottom faces 86 and 88, respectively, of ends 20. It can then be appreciated that posts 82 of tray insert 80 may be positioned in apertures 84 such that tray insert 80 extends either inwardly of frame 18 or outwardly of frame 18.

Now that the basic construction of couch 10 according to the preferred teachings of the present invention have been explained, the use and subtle features of couch 10 can be set forth and appreciated. Specifically, upholstery material 12 of swing couch 10 according to the teachings of the present invention provides a hammock-type support for the user sitting in frame 18. Thus, upholstery material 12 generally conforms to the contours of the user's body. Seat support 38 abuts with the outer surface of upholstery material 12 and provides additional support for the buttocks of the user, such that the user sits on upholstery material 12 between seat support 38 and lower cross beam 16 with the knees located adjacent lower cross beam 16 and the legs extending downwardly therefrom generally parallel to outer face 46 of lower cross beam 16. Back support 26 abuts with the outer surface of upholstery material 12 and provides additional support for the shoulders and back of the user sitting in swing couch 10 against upholstery material 12.

Wrapping upholstery material 12 around upper and lower cross beams 14 and 16 according to the teachings of the present invention allows securement with minimal adherence of material 12 as two to three corners of beams 14 and 16 are engaged by material 12. Thus, material 12 may be easily adjusted and fitted by the owner of the couch 10. Further, only the outside edges of material 12 are aesthetically exposed such that minimum sewing is required which enhances the ability of material 12 to be purchased separately from frame 18. Additionally, these features allow personal selection and/or frequent changes of the design or pattern of material 12.

Similarly, only ends 20 of frame 18 are aesthetically exposed in couch 10 according to the teachings of the present invention. It can then be appreciated that cross beams 14 and 16, back support 26, and seat support 38 can be formed by relatively inexpensive stock material which is not necessary to be highly finished. On the other hand, ends 20 can take a variety of forms and will alter the overall design of couch 10 according to the teachings of the present invention. Specifically, ends 20 may be formed of square or rectangular cross section stock as shown in the drawings, may consist of a newel, stairway banister end, or like design, may be straight, curved, or hooked, and/or may be formed of a variety of materials including wood, metal, plastic or the like. Thus, the particular design of end 20 utilized will give couch 10 its own unique appearance according to the teachings of the present invention.

Additionally, the preferred construction of frame 18 lends itself to ease of manufacture, storage, shipping, and inventory according to the teachings of the present invention. For example, cross beams 14 and 16, back support 26, and seat support 38 can be of a standard, stock design for use in every style of frame 18 manufactured according to the teachings of the present invention. Further, a large percentage of the manufacturing may be done on two pieces in frame 18, namely ends 20 which are of identical construction according to the teachings of the present invention. Specifically, ends 20 in the most preferred form provide the attachment and support of each of the remaining components of frame 18. In addition to securement of cross beams 14 and 16 thereto, hinges 36 and chains 28 and 40 for securing back and seat supports 26 and 38 are secured exclusively to ends 20 according to the teachings of the present invention. Further, in the most preferred form, provisions 74 and 84 if desired for securement of inserts 70 and 80 to frame 18 are also exclusively located on ends 20 according to the teachings of the present invention. Thus, handling of frame material is reduced as most manufacturing steps occur on ends 20. Similarly, due to the identical construction of opposite ends 20 of frame 18 and the standardized, stock design of beams 14 and 16 and supports 26 and 28, the number of different parts which must be inventoried is reduced while still allowing a wide variety of design selection.

The angle or tilt of swing couch 10 such as the result of its suspension by flaccid member 22 in the preferred teachings of the present invention allows the body of the user to be suspended within frame 18 by upholstery material 12 according to the teachings of the present invention. Specifically, due to the flaccid nature of material 12, material 12 conforms to the natural contours of the user's body while at the same time, material 12 provides support to the skeleton. Thus, the body of the user fills voids such that pressure points are not created. Additionally, the body of the user is allowed movement within frame 18 by material 12. The support provided by couch swing 10 according to the teachings of the present invention invites good posture and eliminates slouching. Specifically, supports 26 and 38 provides the skeletal support necessary for good posture while still allowing material 12 to conform to the user's body contours. Thus, swing couch 10 according to the teachings of the present invention provides support and comfort to the user.

Further, the angle or tilt of swing couch 10 according to the teachings of the present invention envelopes the body of the user and gives swing couch 10 a straight line to its low center of gravity for maximizing swing efficiency. Thus, swing couch 10 according to the teachings of the present invention may be swung with minimal effort considering the mass of swing couch 10 itself as well as of the user's body sitting therein.

Additionally, the angle or tilt of swing couch 10 can be easily adjusted to accommodate for vertical to horizontal positions according to the teachings of the present invention such as by use of pulley 24 and clamp 25 in the preferred construction. Thus, swing couch 10 can be utilized in several functional positions from an upright chair to a recliner to a sleeper, with each functional position obtaining the body conforming and supporting advantages of the present invention.

Now that the basic teachings of the present invention have been explained, many extensions and variations will be obvious to one having ordinary skill in the art. For example, seat support 38 may be secured in a similar manner as back support 26. Specifically, the inner edge of seat support 38 could be pivotally mounted to frame 18 about an axis adjacent and generally parallel to lower cross beam 16 by hinges mounted on ends 20 and with the outer edge of seat support 38 being supported by flaccid member 40.

Similarly, seat support 38 may have a frame construction in a similar manner as back support 26 according to the teachings of the present invention.

Further, although swing couch 10 according to the preferred teachings of the present invention includes several unique features in a synergistic combination which is advantageous, such features may possibly e utilized in different combinations and/or in combination with other features by persons skilled in the art after the teachings of the present invention become known.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. Swing couch for sitting in by a user above a floor comprising, in combination: a generally rectangular frame including an upper horizontal cross beam, a lower horizontal cross beam, and first and second ends extending between the upper and lower horizontal cross beams; means for supporting the frame above the floor, with the user sitting on and being supported by the lower horizontal cross beam; a back support having a width generally equal to but of a size for receipt between the first and second ends of the frame, having a height less than the spacing between the upper and lower horizontal cross beams, and having an upper edge and a lower edge; means for pivotally mounting the upper edge of the back support about an axis parallel to and adjacent the upper horizontal cross beam; and means extending between the back support and the ends of the frame adjustably supporting the lower edge of the back support relative to the frame.

2. The swing couch of claim 1 wherein the back support supporting means comprises a flaccid member extending from the lower edge of the back support to the end of the frame.

3. The swing couch of claim 1 wherein the frame supporting means comprises, in combination: an elongated flaccid member secured to the frame; and means for supporting the elongated flaccid member above the floor.

4. The swing couch of claim 3 wherein the elongated flaccid member has free ends which are secured to the frame; and wherein the flaccid member supporting means comprises, in combination: a pulley supported above the floor, with the elongated flaccid member passing around and being supported by the pulley; and means for selectively preventing movement of the elongated flaccid member around the pulley.

5. The swing couch of claim 4 wherein the selectively preventing means comprises means for clamping the elongated flaccid member together adjacent the pulley.

6. The swing couch of claim 1 further comprising, in combination: a seat support having a width generally equal to but of a size for receipt between the first and second ends of the frame; and means for adjustably supporting the seat support relative to the frame generally parallel to and slightly below the lower horizontal cross beam, with the user sitting on and being supported by and between the lower horizontal cross beam and the seat support.

7. The swing couch of claim 6 wherein the seat support supporting means comprises means for supporting the seat support from the ends of the frame.

8. The swing couch of claim 7 wherein the seat support supporting means comprises a flaccid member extending from the seat support to the end of the frame.

9. The swing couch of claim 7 wherein the pivotally mounting means comprises hinges mounted to the ends of the frame and to the back support; and wherein the frame supporting means comprises means secured to the ends for supporting the frame above the floor.

10. The swing couch of claim 6 further comprising, in combination: upholstery material; and means for draping the upholstery material between and securing the upholstery material to the upper and lower horizontal cross beams.

11. The swing couch of claim 10 wherein the upper and lower horizontal cross beams have corners; wherein the upholstery material has free ends; and wherein the upholstery material draping and securing means comprises, in combination: means secured to the cross beams for clamping the free ends of the upholstery material, with the upholstery material being wrapped around at least two corners of the cross beams to allow securement with minimal adherence of the upholstery material.

12. The swing couch of claim 11 wherein the upholstery material comprises, in combination: a first support layer; a cushion layer applied to the support layer; and a layer of upholstery covering the cushion layer.

13. The swing couch of claim 12 wherein the upholstery material further comprises, in combination: a second support layer located intermediate the cushion layer and the layer of upholstery.

14. The swing couch of claim 10 further comprising, in combination: a plurality of struts; and means for removably securing the struts between the upper and lower horizontal cross beams in a spaced, parallel relationship for holding the upholstery material when the frame is in a horizontal, sleeper position.

15. The swing couch of claim 14 further comprising, in combination: a head and back rest insert; and means for removably attaching the head and back rest insert to the end of the frame.

16. The swing couch of claim 1 further comprising, in combination: a tray insert; and means for removably attaching the tray insert to the end of the frame.

17. Swing couch for sitting in by a user above a floor comprising, in combination: a generally rectangular frame including an upper horizontal cross beam, a lower horizontal cross beam, and first and second ends extending between the upper and lower horizontal cross beams; means for supporting the frame above the floor; a seat support having a width generally equal to but of a size for receipt between the first and second ends of the frame; and means extending between the seat support and the ends of the frame adjustably supporting the seat support relative to the frame generally parallel to and slightly below the lower horizontal cross beam, with the user sitting on and being supported by and between the lower horizontal cross beam and the seat support.

18. The swing couch of claim 17 wherein the seat support supporting means comprises a flaccid member extending from the seat support to the end of the frame.

19. The swing couch of claim 18 further comprising, in combination: upholstery material; and means for draping the upholstery material between and securing the upholstery material to the upper and lower horizontal cross beams.

* * * * *